US007685925B2

(12) United States Patent
Sawdon et al.

(10) Patent No.: US 7,685,925 B2
(45) Date of Patent: Mar. 30, 2010

(54) INTENSIFYING CYLINDER

(75) Inventors: Edwin G. Sawdon, St. Clair, MI (US); Steven J. Sprotberry, Marysville, MI (US); Brian D. Petit, Algonac, MI (US)

(73) Assignee: BTM Corporation, Marysville, MI (US)

( * ) Notice: Subject to any disclaimer, the term of this patent is extended or adjusted under 35 U.S.C. 154(b) by 250 days.

(21) Appl. No.: 11/893,189

(22) Filed: Aug. 15, 2007

(65) Prior Publication Data

US 2009/0044962 A1 Feb. 19, 2009

(51) Int. Cl.
*F01L 15/00* (2006.01)

(52) U.S. Cl. ..... 91/189 R; 91/189 A

(58) Field of Classification Search ..... 91/186, 91/188, 189 R, 189 A; 92/76
See application file for complete search history.

(56) References Cited

U.S. PATENT DOCUMENTS

| | | | | |
|---|---|---|---|---|
| 706,688 | A | | 8/1902 | Reynolds et al. |
| 2,568,228 | A | * | 9/1951 | Forse ..... 91/189 R |
| 2,659,207 | A | * | 11/1953 | Marsden ..... 91/189 R |
| 2,740,258 | A | | 4/1956 | Weber |
| 2,827,766 | A | | 3/1958 | Hufford |
| 2,867,088 | A | | 1/1959 | Kux |
| 2,897,784 | A | * | 8/1959 | Harper ..... 92/107 |
| 3,426,530 | A | | 2/1969 | Georgelin |
| 3,633,365 | A | | 1/1972 | Belknap |
| 4,135,076 | A | | 1/1979 | Beneteau |
| 4,271,671 | A | | 6/1981 | Smeets |
| 4,300,351 | A | | 11/1981 | Grullmeier |
| 4,395,027 | A | | 7/1983 | Nordmeyer |
| 4,499,728 | A | | 2/1985 | Therond |
| 4,993,226 | A | | 2/1991 | De Kok |
| 5,107,681 | A | | 4/1992 | Wolfbauer, III |
| 5,218,821 | A | | 6/1993 | Beneteau |
| 5,247,871 | A | | 9/1993 | Brasca et al. |
| 5,265,423 | A | | 11/1993 | Glaser |
| 5,429,036 | A | | 7/1995 | Latos |
| 5,526,644 | A | | 6/1996 | Brieschke |
| 5,582,009 | A | | 12/1996 | Brieschke |
| 5,649,424 | A | | 7/1997 | Valavaara |
| 5,682,806 | A | * | 11/1997 | Kretzschmar ..... 91/170 R |

(Continued)

OTHER PUBLICATIONS

Tox Pressotechnik product brochure, 12 pages, publication date unknown, but believed to be prior to Aug. 15, 2007.

(Continued)

*Primary Examiner*—F. Daniel Lopez
(74) *Attorney, Agent, or Firm*—Harness, Dickey & Pierce, P.L.C.

(57) ABSTRACT

An intensifier is operable to supply force and includes a housing defining a cavity. A ram is slidably positioned within the cavity and partially extends from the housing. The ram is moveable between retracted and extended positions along a longitudinal axis. First and second links are rotatably coupled to one another about an axis of rotation and are selectively moveable between retracted positions where the axis of rotation is not axially aligned with the ram and partially extended positions where the axis of rotation is axially aligned with the ram. The intensifier includes a plurality of power pistons axially aligned with each other and the ram. The power pistons are selectively operable to provide an output force to the ram when the first and second links are in the partially extended positions.

23 Claims, 8 Drawing Sheets

U.S. PATENT DOCUMENTS

| | | | |
|---|---|---|---|
| 5,865,029 | A | 2/1999 | Brieschke |
| 5,943,862 | A | 8/1999 | Malina |
| 6,735,944 | B2 | 5/2004 | Sawdon |
| 6,779,343 | B2 | 8/2004 | Sawdon |
| 6,996,984 | B2 | 2/2006 | Sawdon et al. |
| 7,194,859 | B1 | 3/2007 | Sawdon et al. |
| 7,263,831 | B2 | 9/2007 | Sawdon et al. |

OTHER PUBLICATIONS

Multicyl product brochure, 8 pages, dated Oct. 1998.

Aries Engineering Company Inc. product brochure, 5 pages, publication date unknown, but believed to be prior to Aug. 15, 2007.

Farger & Joosten product brochure, 4 pages, dated Sep. 1999.

Farger & Joosten product brochure, 2 pages, dated Mar. 1999.

Alfamatic product information from website, 2 pages, publication date unknown, but believed to be prior to Aug. 15, 2007.

G.P.A. Italiana S.p.A. product information from website, 2 pages, publication date unknown, but believed to be prior to Aug. 15, 2007.

OHMA Piercing Cylinder Product Guide, Version 3.0, 36 pages, dated 2003.

* cited by examiner

INTENSIFYING CYLINDER

BACKGROUND

The present disclosure generally relates to a fluid powered device to perform work. More particularly, a pneumatically powered intensifying cylinder is described.

The manufacturing industry utilizes various intensified fluid powered devices to perform work. Some of these devices may produce 100 or more tons of output force. One such device utilizes air at various input pressures to drive a piston and rod into a sealed hydraulic chamber. An intensified output force acts on a working piston rod. Pressures in excess of 6,000 psi may be generated in a sealed hydraulic chamber. Due to these high operating pressures, seals may require replacement from time to time. Furthermore, such systems may also be subject to air entering into the hydraulic chamber. The accumulated air may adversely affect the performance of the cylinder and may require purging from the system.

Some intensified fluid powered devices include springs to return internal pistons. The springs may be subject to breakage and may have a potential to damage the cylinder should breakage occur. Furthermore, special valving is required to sequence the operation of the various components of the intensified fluid powered device. To obtain a desired output force, some models require an input pressure of approximately 145 psi to be supplied. Accumulators or special air compressors may be required to provide this magnitude of input pressure.

Another high force output device that operates with an input of relatively low pressure air is known as an air toggle press. This simple device produces a greatly magnified force output through a toggle linkage mechanism. However, the air toggle press does not produce a straight-line constant force output that may be desirable in some applications. The seals and the cylinder of the air toggle press are exposed to relatively low pressures only.

Many of the previously described assemblies may require anti-rotation devices to maintain proper orientation of certain components during the work stroke. These devices may be added either internally or externally depending on unit design and space constraints.

SUMMARY

An intensifier is operable to supply force and includes a housing defining a cavity. A ram is slidably positioned within the cavity and partially extends from the housing. The ram is moveable between retracted and extended positions along a longitudinal axis. First and second links are rotatably coupled to one another about an axis of rotation and are selectively moveable between retracted positions where the axis of rotation is not axially aligned with the ram and partially extended positions where the axis of rotation is axially aligned with the ram. The intensifier includes a plurality of power pistons axially aligned with each other and the ram. The power pistons are selectively operable to provide an output force to the ram when the first and second links are in the partially straight line extended positions.

Also disclosed is an intensifier operable for supplying force to a workpiece. The intensifier includes a housing and a ram at least partially slidably positioned within the housing. The ram is moveable between a retracted position and an extended position and is adapted to supply force to the workpiece. The intensifier includes a plurality of pistons selectively operable to provide force to the ram. A valve rod is fixed to the ram. The valve rod is positioned within the housing and operable to open a passageway and supply pressurized air to the pistons after the ram has moved to an intermediate position between the extended position and the retracted position.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
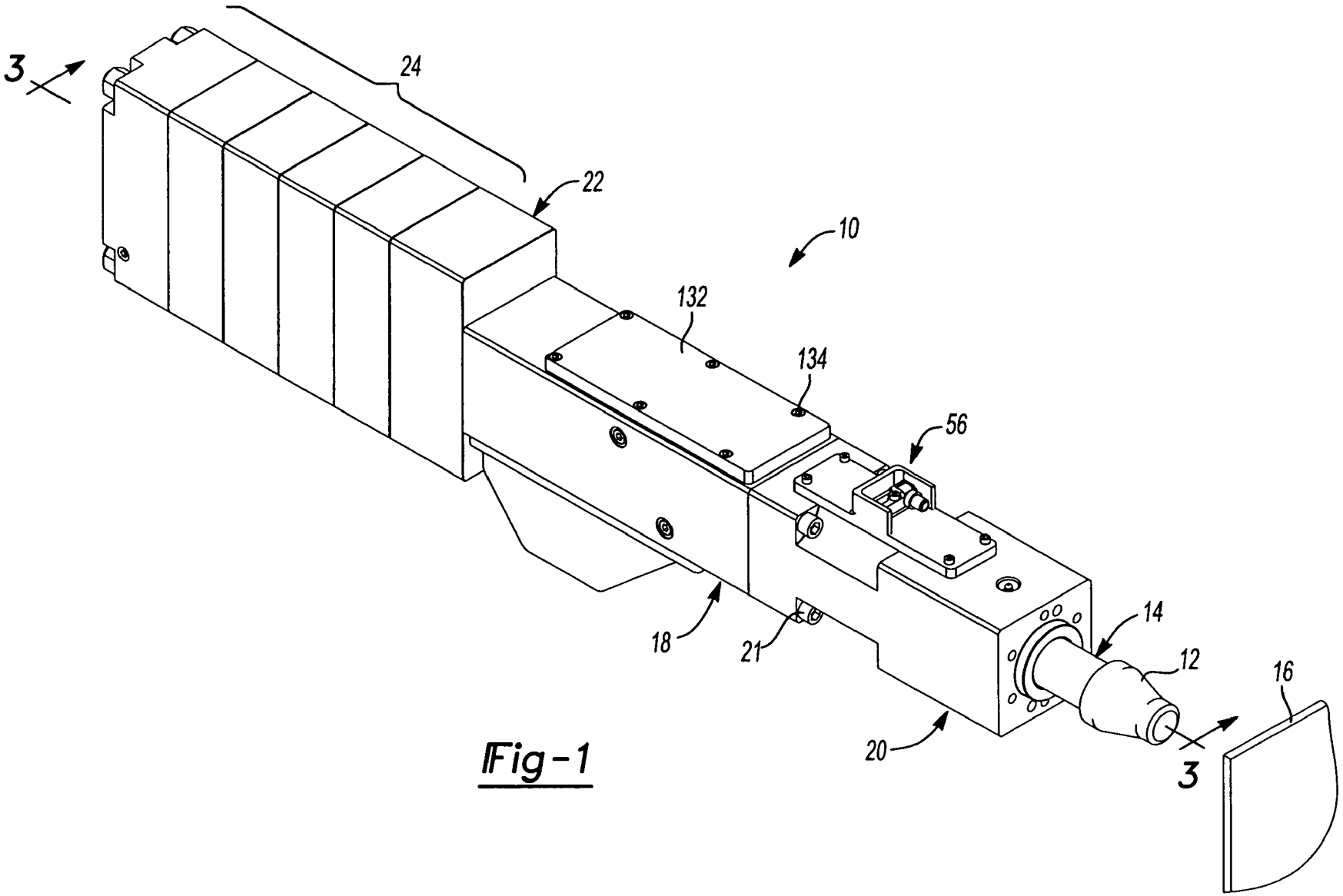
FIG. 1 is perspective view of an air-to-air intensifier.
Figure 2:
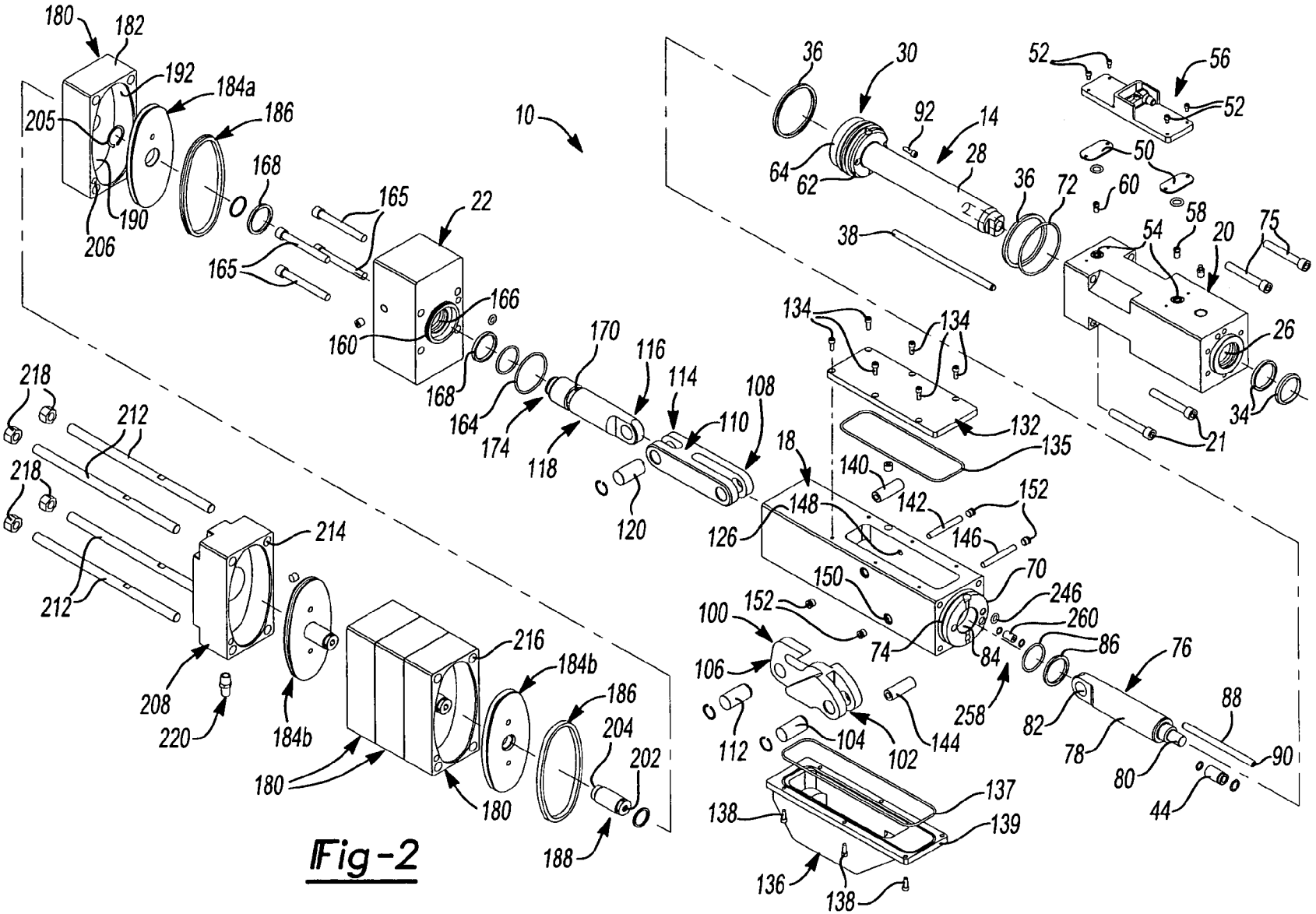
FIG. 2 is an exploded perspective view of the intensifier shown in FIG. 1.
Figure 3:
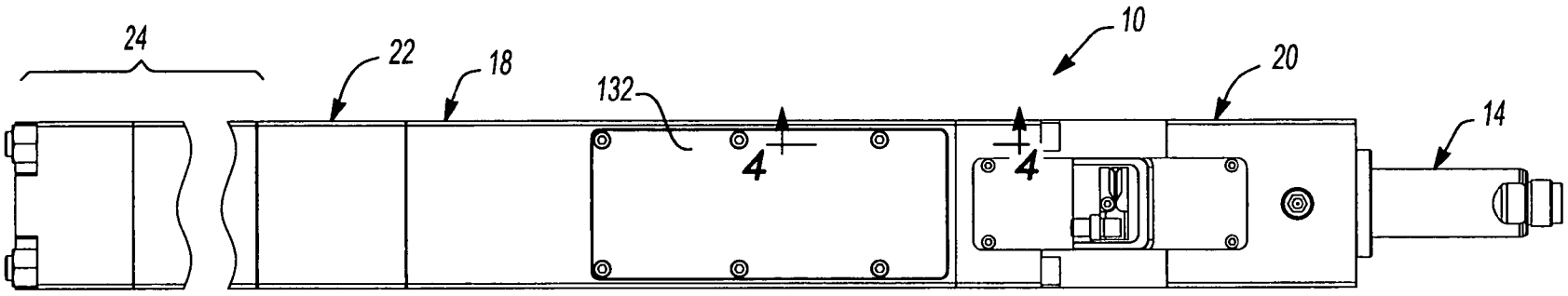
FIG. 3 is a top view of the intensifier shown in FIG. 1.
Figure 4:
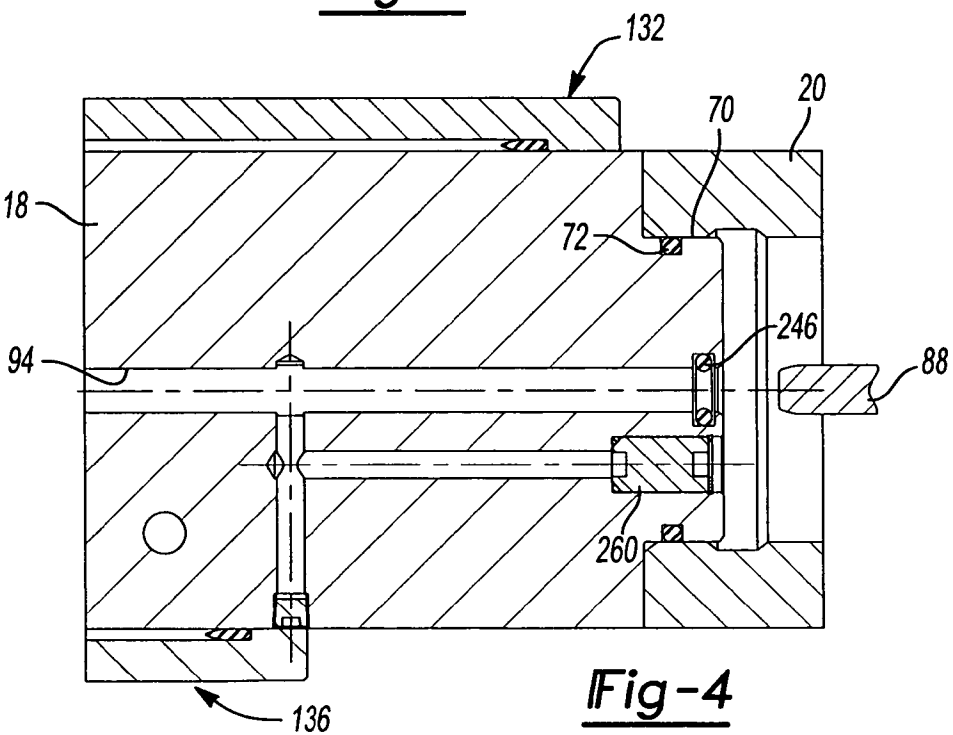
FIG. 4 is a cross-sectional view taken along line 4-4 as shown in FIG. 3.

The following description is merely exemplary in nature and is not intended to limit the present disclosure, application, or uses. It should be understood that throughout the drawings, corresponding reference numerals indicate like or corresponding parts and features.

With reference to FIGS. 1-9B, an air-to-air pressure intensifier assembly constructed in accordance with the teachings of the present disclosure is identified at reference numeral 10. Intensifier assembly 10 functions to provide a relatively large output force at a driven end using only compressed air at a relatively low input pressure ranging from approximately 65-100 psi as the power source. Intensifier assembly 10 utilizes only air throughout the mechanism and does not include a cavity storing liquid. Intensifier assembly 10 produces a constant, straight-line working force output.

Typically, the driven end of the pressure intensifier is coupled to tooling such as a clamp half, a rivet hammer or a punch, collectively identified as a tool 12. Intensifier assembly 10 operates by advancing and retracting a ram 14 to place tool 12 into engagement with a workpiece 16. Intensifier assembly 10 operates to rapidly translate tool 12 toward workpiece 16 at a relatively low force. Once ram 14 extends a predetermined distance, intensifier assembly 10 generates a greatly multiplied force between tool 12 and workpiece 16. On the return stroke, an enlarged head of ram 14 provides a relatively large pressurized working area to retract ram 14 for the next work cycle.

Intensifier assembly 10 includes a substantially rectangular middle housing 18 in slidable receipt of ram 14. A front housing 20 is coupled to one end of middle housing 18 via threaded fasteners 21. A power module adapter 22 is coupled to an opposite end of middle housing 18. A power module 24 is mounted to power module adapter 22.

Front housing 20 includes a throughbore 26 in sliding receipt of ram 14. Ram 14 includes a substantially cylindrically shaped rod portion 28 extending through front housing 20 and an enlarged head portion 30 slidably positioned within a first cavity 32 formed within front housing 20. Seals 34 are positioned in grooves formed within front housing 20 to sealingly engage rod portion 28 and resist ingress of contamination. Additional seals 36 are positioned within grooves formed on head portion 30 to sealingly engage the walls of first cavity 32. Enlarged head portion 30 functions as a piston moveable relative to front housing 20.

An anti-rotate rod 38 has a first end mounted within a pocket 40 formed within front housing 20. A second end of anti-rotate rod 38 is positioned within a pocket 42 formed in middle housing 18. Anti-rotate rod 38 extends through head portion 30 and is supported by an anti-rotate bearing 44 coupled to ram 14. Anti-rotate bearing 44 and ram 14 are operable to axially slide relative to anti-rotate rod 38. Accordingly, ram 14 may axially translate within first cavity 32 but is restricted from rotation relative to middle housing 18 and front housing 20.

Figure 5A:
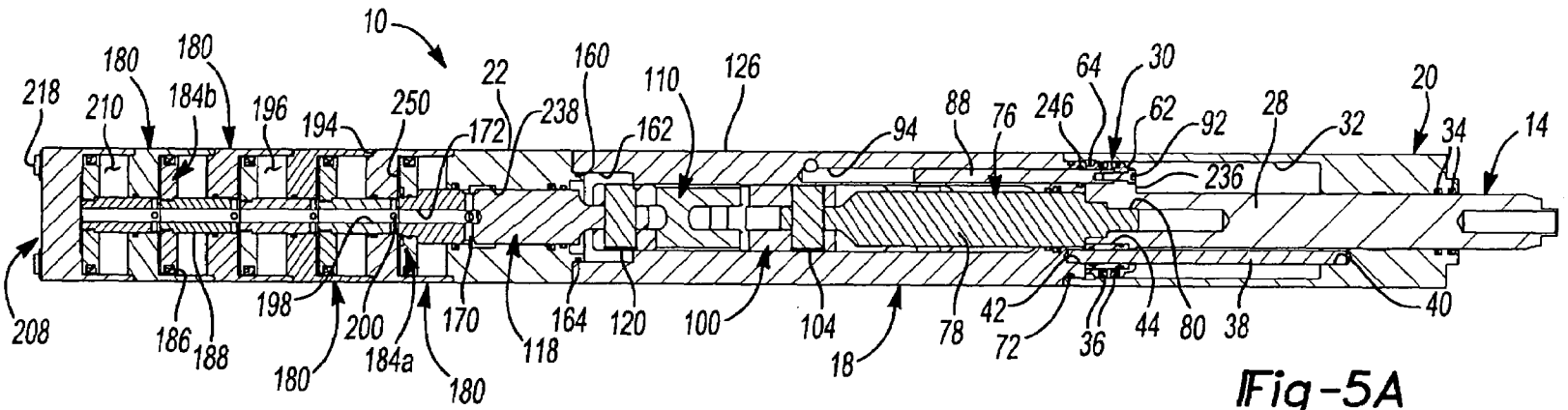
FIG. 5A is a top cross-sectional view of the intensifier showing a ram in a fully retracted position.
Figure 5B:
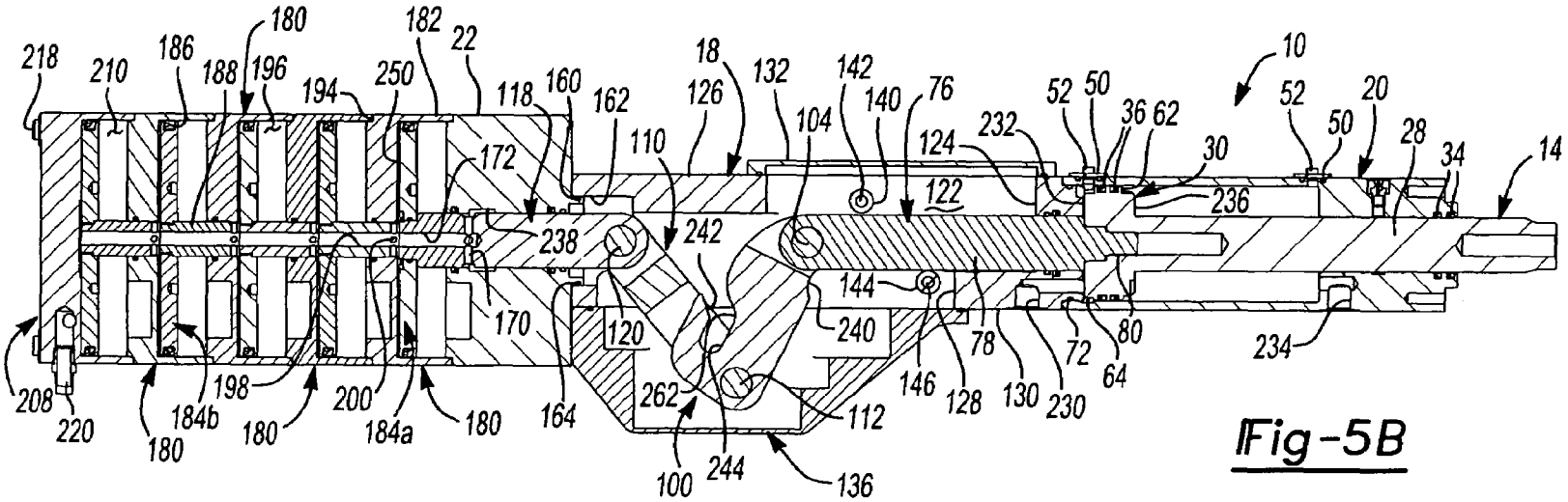
FIG. 5B is a side cross-sectional view of the intensifier showing the ram in the fully retracted position.
Figure 6A:
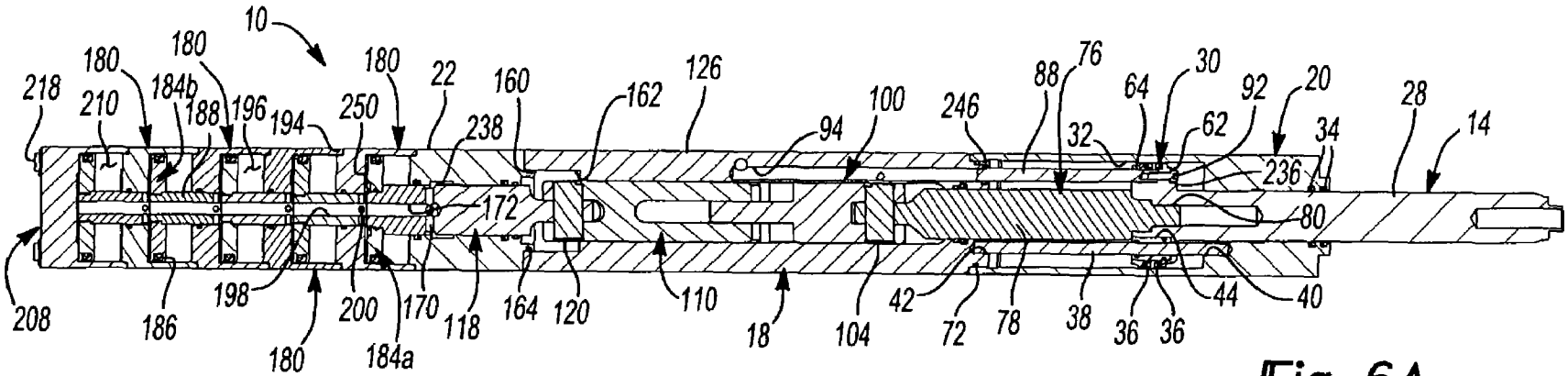
FIGS. 6A-9B are top and side cross-sectional views substantially similar to FIGS. 5A and 5B except that the ram is sequentially moved toward the fully extended position depicted in FIGS. 9A and 9B.
Figure 6B:
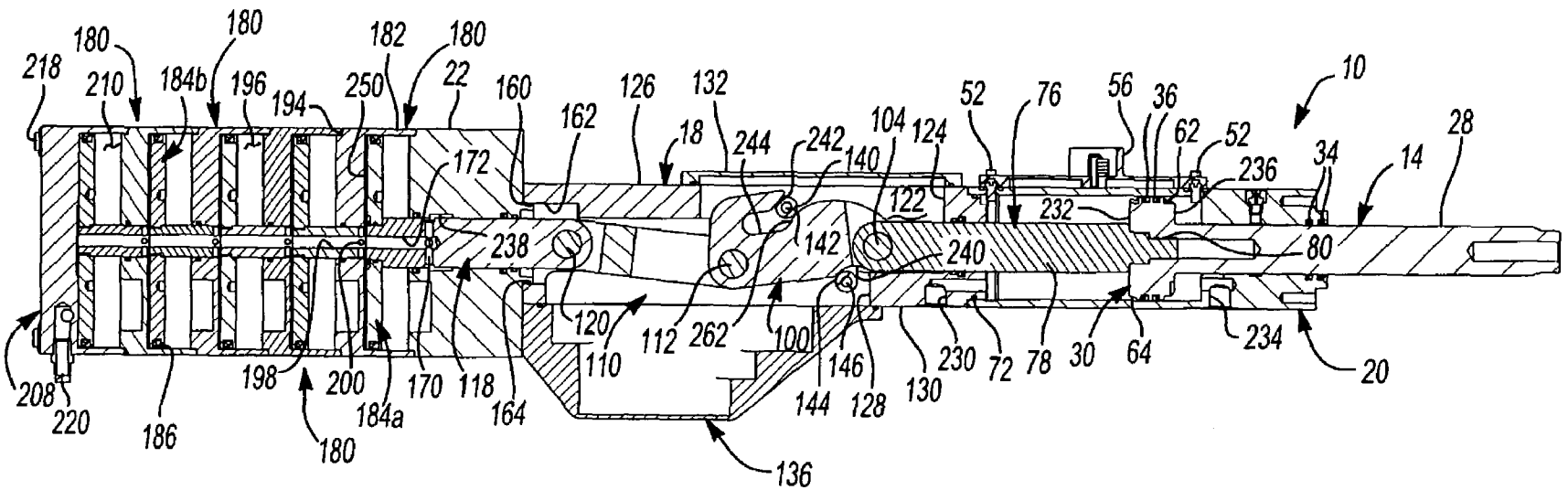
Figure 9A:
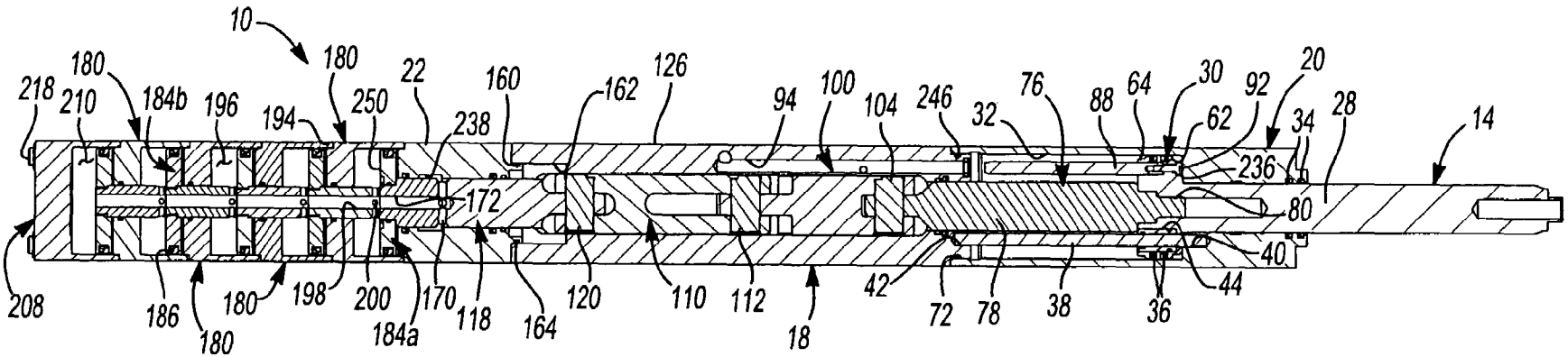
Figure 9B:
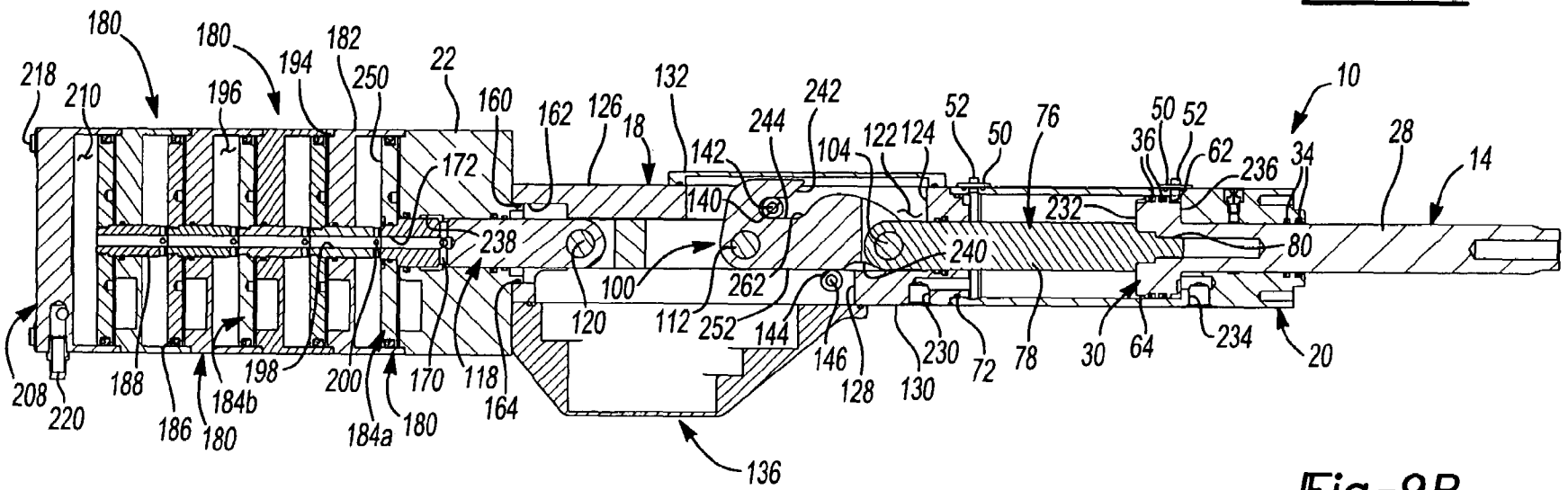

Cover plates 50 are secured to front housing 20 with threaded fasteners 52 to cover proximity sensor apertures 54 extending through front housing 20. An optional proximity sensor sub-assembly 56 may be coupled to front housing 20 in lieu of cover plates 50 if desired. If so equipped, intensifier assembly 10 may include a first sensor head 58 positioned within aperture 54 closest to workpiece 16. A second sensor head 60 is positioned in the other sensor aperture 54 proximate middle housing 18. Enlarged head portion 30 includes a first land 62 that is positioned adjacent first sensor head 58 when ram 14 is in a fully extended position as shown in FIGS. 9A and 9B. A second land 64 is formed on enlarged head portion 30 and is positioned adjacent to second sensor head 60 when ram 14 is in a fully retracted position as depicted in FIGS. 5A and 5B. Proximity sensor sub-assembly 56 is operable to output signals indicative of ram 14 being in the fully retracted and the fully extended positions.

Middle housing 18 includes an axially extending boss 70 sized to cooperate with a recess formed within front housing 20. An o-ring 72 is positioned within a groove 74 formed on boss 70 to sealingly engage both middle housing 18 and front housing 20. Fasteners 21 fix front housing 20 to middle housing 18.

A front connecting rod 76 is threadably coupled to ram 14. Front connecting rod 76 includes a substantially cylindrically-shaped middle portion 78, a first end 80 having a reduced diameter with an external thread and a second flattened end 82. Front connecting rod 76 is slidably positioned within an aperture 84 extending through middle housing 18. Seals 86 are positioned within grooves formed within aperture 84 to sealingly engage middle portion 78 of front connecting rod 76. A valve rod 88 has a first end 90 fixed to ram 14 by a fastener 92. Valve rod 88 extends substantially parallel to front connecting rod 76 and is operable to selectively open and close a passageway 94 formed in middle housing 18 as will be described in detail hereinafter.

A cam link 100 includes a bifurcated first end 102 coupled for rotation with second end 82 of front connecting rod 76 by a link pin 104. A second end 106 of cam link 100 is rotatably coupled to a first end 108 of a cam link 100 by another link pin 112. First end 108 of link 110 is bifurcated to receive second end 106 of cam link 100. A second end 114 of link 110 is also bifurcated to receive a first end 116 of a rear connecting rod 118. Rear connecting rod 118 is rotatably coupled to link 110 by a link pin 120. Front connecting rod 76, cam link 100, link 110 and rear connecting rod 118 are moveable within a cavity 122 formed within middle housing 18.

An aperture 124 extends through a first surface 126 of middle housing 18 to allow access to cavity 122. Similarly, another aperture 128 extends through a second surface 130 of middle housing 18. A first cover 132 is fixed to middle housing 18 via a plurality of threaded fasteners 134 to seal cavity 122 from the atmosphere. A seal 135 is retained within a groove formed on first cover 132 to sealingly engage first surface 126 of middle housing 18. A second cover 136 is fixed to middle housing 18 with a plurality of fasteners 138. A seal 137 is retained within a groove formed in a flange 139 of second cover 136. Seal 137 and second cover 136 enclose cavity 122. It is contemplated that cavity 122 may be filled with a lubricant and sealed for the useful life of intensifier assembly 10.

An upper roller 140 is positioned within cavity 122 and rotatable about an upper pivot pin 142. A lower roller 144 is supported for rotation within cavity 122 on a lower pivot pin 146. Upper pivot pin 142 and lower pivot pin 146 are supported within upper and lower apertures 148, 150 respectively formed in middle housing 18. Plugs 152 are coupled to middle housing 18 to retain upper pivot pin 142 and lower pivot pin 146 in proper position.

Power module adapter 22 includes a boss 160 sized for receipt within a bore 162 formed within middle housing 18. A seal 164 is retained within the groove formed on boss 160. Power module adapter 22 is fixed to middle housing 18 by a plurality of fasteners 165. An aperture 166 extends through power module adapter 22. Rear connecting rod 118 is slidably supported therein. Seals 168 are positioned within grooves formed within aperture 166 to sealingly engage rear connecting rod 118. Rear connecting rod 118 also includes a plurality of transversely extending passageways 170 in communication with an axially extending passage 172. Axially extending passage 172 exits rear connecting rod 118 at a second end 174. Second end 174 is fixed to a power piston 184.

Power module 24 includes a plurality of power module subassemblies 180. It should be appreciated that the number of power module subassemblies 180 may vary based on desired force output. Each power module subassembly 180 includes a cylinder housing 182, a power piston 184, a power piston seal 186 and a power piston rod 188. Each cylinder housing 182 is substantially rectangularly shaped and includes an end wall 190 and an oval cavity defined by a side wall 192. The oval narrow shape of each cylinder housing 182 maintains the thinness of intensifier assembly 10. Each end wall includes a stepped oval-shaped surface 194 sized and shaped to meet with the side wall 192 of an adjacent power module subassembly 180.

A cavity 196 is formed when adjacent cylinder housings 182 are coupled to one another. Each power piston 184 is slidable within cavity 196. Each power piston rod 188 includes an axial throughbore 198 and transversely extending passageways 200 in communication with each other. Passageways 200 are located at one end of power piston rod 188. Each power piston rod 188 includes a front end face 202 and a rear end face 204. The power pistons 184 may differ slightly from one another in the manner each power piston 184 is coupled to its adjacent member. For example, power piston 184*a* adjacent rear connecting rod 118 is coupled thereto via a snap ring 205. The other power pistons 184*b* are threadingly engaged to their respective power piston rods 188. Each cylinder housing 182 includes an exhaust passageway 206 allowing a portion of each cavity 196 to communicate with the atmosphere. Furthermore, while power pistons 184 are described and shown as having an outer oval-shaped surface, it is contemplated that power pistons 184 and their respective cavities 196 may include circular or elongated outer surface shapes.

An end cap 208 houses one of power pistons 184 within a cavity 210 defined by end cap 208 and an adjacent cylinder housing 182. Elongated rods 212 extend through apertures 214 formed in end cap 208 and apertures 216 extending through each cylinder housing 182. One end of each rod 212 is fixed to power module adapter 22. The opposite ends of rods 212 protrude through end cap 208. Nuts 218 threadingly engage rods 212 to clamp power module 24 to power module adapter 22. A muffler 220 is mounted to end cap 208 in communication with exhaust passageway 206.

Intensifier assembly 10 may be coupled to a four-way air valve (not shown) for operation. This valve may be purchased from any number of valve manufacturers. The four-way air valve (not shown) may be coupled to an advance port 230 formed in middle housing 18. Advance port 230 is plumbed in communication with cavity 32 and a rear face 232 of head portion 30 of ram 14. The four-way air valve may also be coupled to a retract port 234 formed in front housing 20. Retract port 234 is in fluid communication with cavity 32 and a front face 236 of head portion 30. A description of the operation of intensifier assembly 10 begins with each power piston 184, rear connector rod 118, link 110, cam link 100, front connecting rod 76 and ram 14 in a retracted position as shown in FIGS. 5A and 5B.

To actuate intensifier assembly 10, pressurized air is provided to advance port 230 and retract port 234 is opened to atmosphere. Pressurized air acts on rear face 232 and ram 14 translates to a partially advanced or partially extended position depicted in FIGS. 6A and 6B. During translation of ram 14 from the fully retracted position to the partially advanced position shown in FIGS. 6A and 6B, front connecting rod 76 linearly translates within cavity 122 guided along a desired path by the walls of aperture 84 as well as cam rollers 140, 144. At this time, valve rod 88 axially translates in passageway 94 and draws a slight vacuum within a passageway formed within power module adapter 22 in communication with a relief 238. Relief 238 is in fluid communication with passageways 170, 172, 198 and 200. Accordingly, each power piston 184 maintains its fully retracted position. Power pistons 184 remain in their retracted positions while front connecting rod 76 translates causing cam link 100 and link 110 to rotate to the positions depicted in FIGS. 6A and 6B. In particular, a first cam face 240 formed on cam link 100 engages lower roller 144 causing cam link 100 to rotate about link pin 104. In addition, a second cam face 242 formed on cam link 100 engages upper roller 140 to begin to align a slot 244 formed in cam link 100 with upper roller 140.

Figure 7A:
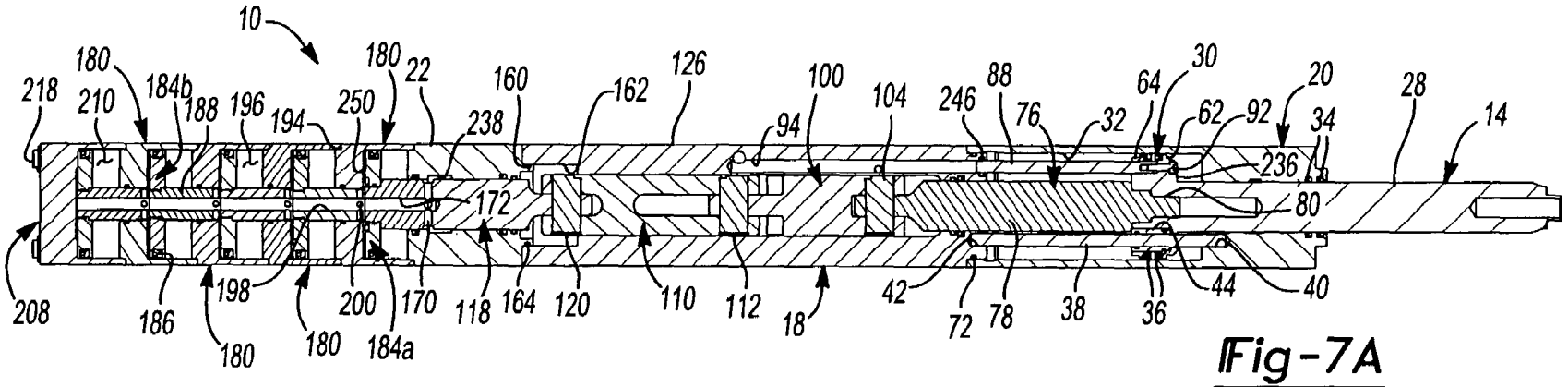
Figure 7B:
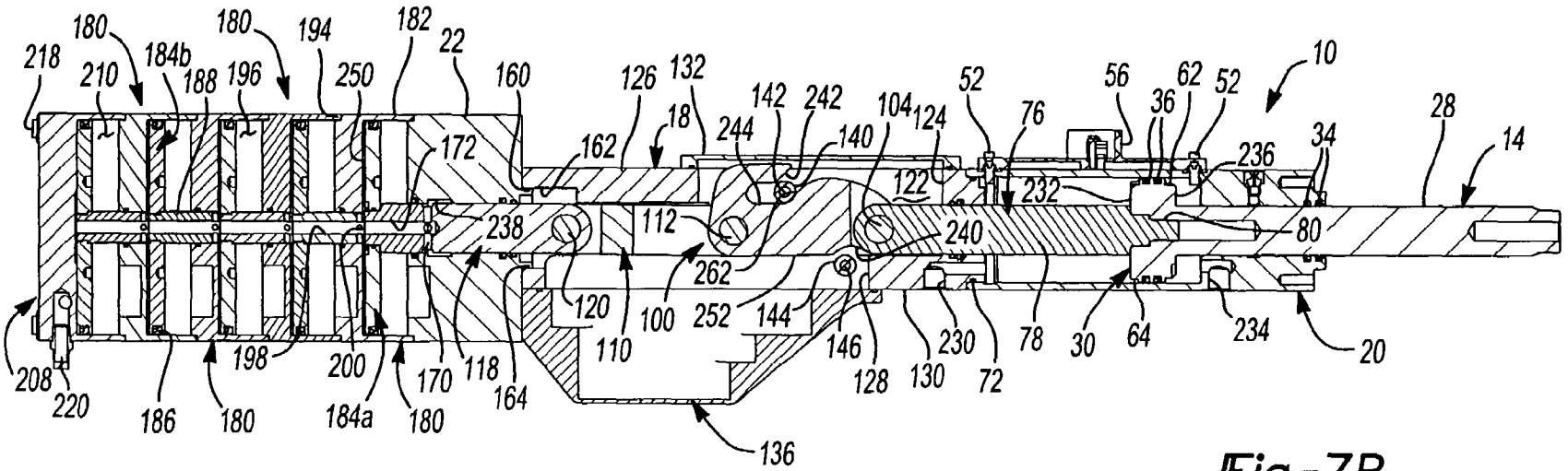

FIGS. 7A and 7B depict ram 14 axially translated at a partially extended position further toward a fully advanced position. At this location, link pins 104, 112 and 120 are substantially coaxially aligned with one another. Ram 14, forward connecting rod 76, cam link 100, link 110 and rear connecting rod 118 are each substantially coaxially aligned with one another at this partially extended position. First cam face 240 is disengaged from lower roller 144 and upper roller 140 is aligned with slot 244. Valve rod 88 remains sealingly engaged with a seal 246 positioned within passageway 94. Power pistons 184 remain at their fully retracted positions. The position of ram 14 roughly corresponds to a position where tool 12 initially contacts or is proximate to workpiece 16.

Figure 8A:
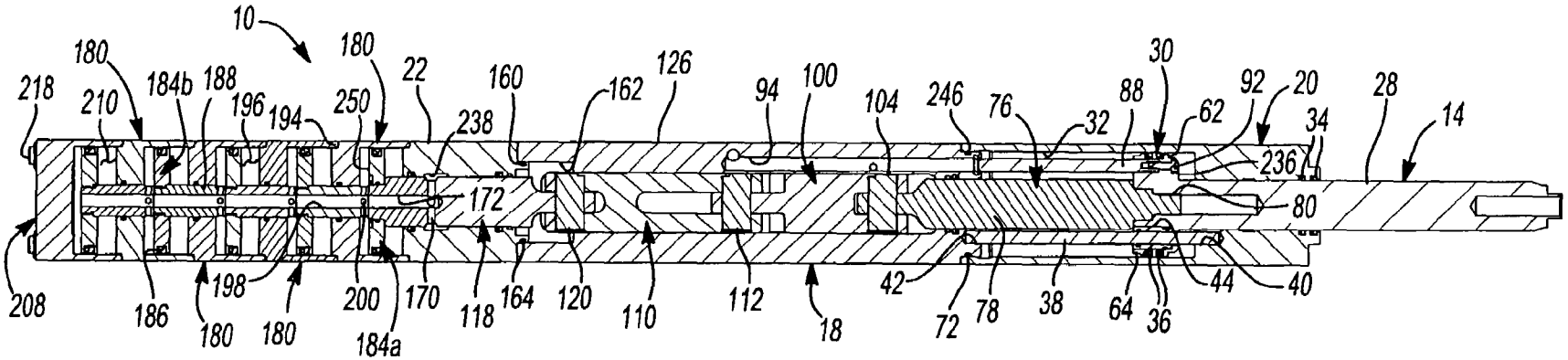
Figure 8B:
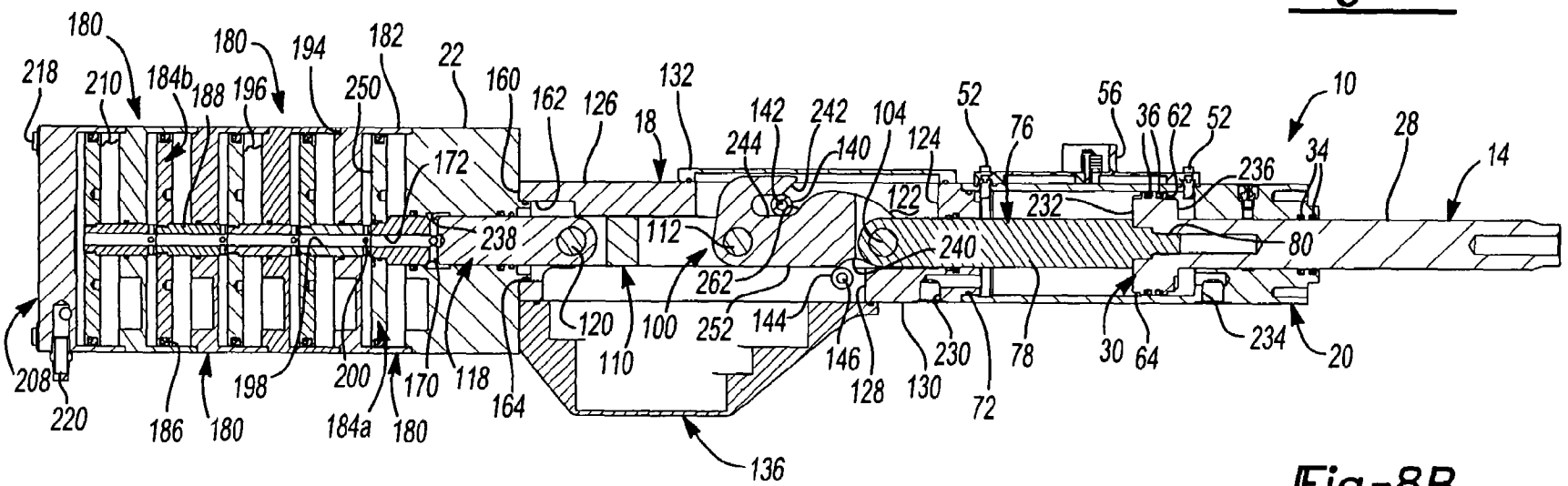

FIGS. 8A and 8B depict ram 14 indexed only slightly further toward the fully advanced position. However, at this time valve rod 88 disengages seal 246 to allow pressurized fluid to enter passageway 94. The pressurized fluid travels through power module adapter 22, relief 238, passageways 170, 172, 198 and 200 to apply pressurized fluid to back faces 250 of each power piston 184.

One skilled in the art will appreciate that greatly amplified force is provided to ram 14 due to the summed surface area of each power piston 184 and head portion 30 of ram 14 being acted upon by pressurized air. Once each of the power pistons 184 has been provided with pressurized air as described, power pistons 184, power piston rods 188, rear connecting rod 118, link 110, cam link 100, front connecting rod 76 and ram 14 move to the fully advanced position as shown in FIGS. 9A and 9B. It is contemplated that the work to be completed on the workpiece 16 occurs during the time when ram 14 travels from the partially advanced position shown in FIGS. 8A and 8B to the fully advanced position depicted in FIGS. 9A and 9B. The distance traveled during this portion of the advance stroke corresponds to approximately the 15mm of travel that each power piston 184 may travel. It should be noted that the total stroke of ram 14 relates to the length of cavity 32 and the thickness of head portion 30 of ram 14. A number of different rams may be provided with various head thicknesses to vary the stroke of intensifier assembly 10.

Furthermore, during the power stroke portion of advancing from FIGS. 8A and 8B to FIGS. 9A and 9B, upper roller 140 is positioned within slot 244 while a third cam surface 252 of cam link 100 engages lower roller 144 to restrict cam link 100 from rotation. Load is transferred through link pins 104, 112 and 120 in shear. Rear connecting rod 118, link 110, cam link 100, first connecting rod 76 and ram 14 are each loaded in axial compression with little to no bending load being applied.

After the clamping, gripping, or forming work has been completed, pressurized air is no longer supplied to advance port 230 but instead is provided to retract port 234. Advance port 230 is vented to atmosphere. Pressurized air is provided to front face 236 of head portion 30 of ram 14. Ram 14 begins to translate axially from the fully extended position toward the retracted position. Based on the features of cam link 100 and the position of upper roller 140 and lower roller 144, link pin 104, 112 and 120 remain axially aligned during the first portion of a retraction stroke to cause power pistons 184 to move to their fully retracted position. Air positioned within cavities 196 and 210 is forced through exhaust passageways 206 formed in cylinder housings 182 and exhausts through muffler 220 to atmosphere. Continued movement of ram 14 toward a retracted position causes valve rod 88 to sealingly engage seal 246 and enter passageway 94.

To assure that air is not trapped within passageway 94 thereby possibly resisting entry of valve rod 88, a pressure relief system 258 is provided. Pressure relief system 258 includes a one-way check valve 260 placed in communication with passageway 94 and cavity 32. Pressurized fluid may travel from passageway 94 into cavity 32 but fluid flow in the opposite direction is restricted.

Ram 14 continues to move toward the fully retracted position driven by pressurized air supplied through retract port 234. During retraction, cam link 100 axially translates until a fourth cam face 262 formed on cam link 100 engages upper roller 140. Continued retraction of ram 14 causes cam link 100 and link 110 to pivot and collapse within second cover 136 until the fully retracted position depicted in FIGS. 5A and 5B is reached. At this time, each of ram 14, front connecting rod 76, cam link 100, link 110, rear connecting rod 118 and each of power pistons 184 are in their retracted positions ready to begin the next work cycle.

While the Figures depict intensifier assembly 10 in a certain orientation and certain elements may be referenced as top or bottom or first or second, it should be appreciated that intensifier assembly 10 may operate in a number of orientations other than those depicted in the Figures. Additionally, the stroke of ram 14 is depicted as being three to four times greater than a stroke of the power pistons. This ratio may be varied as desired. It should be appreciated that the magnitude of the stroke of the power pistons and the number of power pistons used in conjunction with one another may be varied to meet the needs of the operation to be accomplished. Furthermore, the ratio of the total amount of travel available to ram 14 relative to the portion of that stroke that may include intensified force may also be varied by a number of means including increasing the thickness of head portion 30 or changing the depth of first cavity 32. Additionally, it is contemplated that front housing 20, middle housing 18, power module adapter 22 and cylinder housings 182 may be constructed from an aluminum alloy. However, other suitable materials such as steel or plastic may be used.

Furthermore, the foregoing discussion discloses and describes merely exemplary embodiments of the present disclosure. One skilled in the art will readily recognize from such discussion, and from the accompanying drawings and claims, that various changes, modifications and variations may be made therein without departing from the spirit and scope of the disclosure as defined in the following claims.

What is claimed is:

1. An intensifier for supplying force, the intensifier comprising:

a housing defining a cavity;

a ram slidably positioned within the cavity and partially extending from the housing, the ram being moveable between retracted and extended positions along a longitudinal axis;

first and second links rotatably coupled to one another about an axis of rotation, the links being selectively moveable between retracted positions where the axis of rotation is not axially aligned with the ram and partially extended positions where the axis of rotation is axially aligned with the ram, wherein the first link includes a slot in receipt of a pin fixed to the housing to restrict the first link from rotating when in the partially extended position; and a plurality of power pistons axially aligned with each other and the ram, the plurality of power pistons being selectively operable to provide an output force to the ram when the first and second links are in the partially extended positions.

2. The intensifier of claim 1 further including a forward connecting rod having a first end pivotally coupled to the first link and a second end fixed to the ram.

3. The intensifier of claim 2 wherein the forward connecting rod is axially moveable collinearly with the ram.

4. The intensifier of claim 3 further including a rear connecting rod having a first end pivotally coupled to the second link and a second end driven by the plurality of power pistons.

5. The intensifier of claim 4 further including a first link pin pivotally interconnecting the forward connecting rod and the first link, a second link pin pivotally interconnecting the first link and the second link and a third link pin pivotally interconnecting the second link and the rear connecting rod.

6. The intensifier of claim 5 wherein the first and third link pins are aligned along an axis of translation of the ram when the first and second links are in either of the retracted and partially extended positions.

7. The intensifier of claim 5 wherein the second link pin is positioned in alignment with the ram axis of translation when the first and second links are in their partially extended positions.

8. The intensifier of claim 1 wherein the pin is clear of the slot when the first link is in the retracted position.

9. The intensifier of claim 8 wherein the first link includes a cam surface engaging the pin to cause the first link to rotate during movement from the partially extended position to the retracted position.

10. The intensifier of claim 9 wherein the first link includes another cam surface engaging another pin having a position fixed relative to the housing to cause the first link to rotate during movement from the retracted position to the partially extended position.

11. The intensifier of claim 1 wherein the ram is coupled to a piston and the piston is in receipt of pressurized fluid before the power pistons are acted on by pressurized fluid as the ram moves from the retracted to the extended position.

12. The intensifier of claim 1 wherein the plurality of power pistons include an outer surface having one of a round, oval or elongated shape.

13. The intensifier of claim 1 wherein the first and second links are positioned in a sealed cavity containing lubrication.

14. The intensifier of claim 1 further including an anti-ram rotation rod mounted within the cavity to restrict the ram from rotation.

15. An intensifier for supplying force to a workpiece, the intensifier comprising:

a housing;

a ram at least partially slidably positioned within the housing, the ram being moveable between a retracted position and an extended position and being adapted to supply force to the workpiece;

a plurality of pistons selectively operable to provide force to the ram; and a valve rod fixed to the ram, positioned within the housing and operable to open a passageway and supply pressurized air to the plurality of pistons after the ram has moved to an intermediate position between the extended position and the retracted position, wherein the valve rod extends substantially parallel to and transversely offset from the ram.

16. The intensifier of claim 15 further including a piston fixed to the ram and slidably positioned within a cavity formed in the housing, the passageway having an opening in communication with the cavity.

17. The intensifier of claim 16 further including a linkage having first and second pivotal links interconnecting the plurality of pistons and the ram.

18. The intensifier of claim 17 wherein a pivot point between the first and second links moves from a positioned aligned with an axis of translation of the ram to a position offset from the axis when the ram moves from the extended position to the retracted position.

19. The intensifier of claim 15 wherein each of the pistons is fixed to a hollow rod including a substantially transversely extending passageway in communication with one another.

20. The intensifier of claim 15 further including an anti-ram rotation rod mounted within the housing to restrict the ram from rotation.

21. A method of operating an intensifier having a longitudinally translatable ram, axially and pivotally moveable first and second links and a plurality of power pistons, the method comprising:

applying pressurized air to the ram;

moving the ram from a retracted position to a partially extended position;

moving the first and second links from retracted positions where the first and second links are not coaxially aligned to partially extended positions where the first and second links are substantially coaxially aligned with the ram;

positioning a pin within a slot formed in the first link to restrict the first and second links from rotation when in the partially extended positions; and applying pressurized air to the plurality of power pistons to provide a force acting on the first link, the second link and the ram to output an amplified force and move the ram to a fully extended position.

22. The method of claim 21 further including opening an internal valve to supply pressurized air to the plurality of power pistons after the first and second links are in the partially extended position.

23. The method of claim 21 further including restricting the ram from rotation while moving between the retracted and fully extended positions.

* * * * *